US010548348B2

(12) United States Patent
Levilev et al.

(10) Patent No.: US 10,548,348 B2
(45) Date of Patent: Feb. 4, 2020

(54) SIMULATED CIGARETTE

(71) Applicants: Nossen K. Levilev, Hallandale, FL (US); Chaim Levilev, Hallandale, FL (US)

(72) Inventors: Nossen K. Levilev, Hallandale, FL (US); Chaim Levilev, Hallandale, FL (US)

(73) Assignee: Harmless Products, LLC, Hollywood, FL (US)

( * ) Notice: Subject to any disclaimer, the term of this patent is extended or adjusted under 35 U.S.C. 154(b) by 79 days.

(21) Appl. No.: 15/901,318

(22) Filed: Feb. 21, 2018

(65) Prior Publication Data

US 2018/0235275 A1 Aug. 23, 2018

Related U.S. Application Data

(60) Provisional application No. 62/462,141, filed on Feb. 22, 2017.

(51) Int. Cl.
*A24F 47/00* (2006.01)

(52) U.S. Cl.
CPC ..... *A24F 47/002* (2013.01)

(58) Field of Classification Search
None
See application file for complete search history.

(56) References Cited

U.S. PATENT DOCUMENTS

| | | | | |
|---|---|---|---|---|
| 4,083,372 | A * | 4/1978 | Boden | A24F 47/002 128/202.21 |
| 4,716,912 | A * | 1/1988 | Leonard | A24D 3/041 131/198.2 |
| 4,821,670 | A | 4/1989 | Foxcroft et al. | |
| 4,904,308 | A * | 2/1990 | Charlton | A24D 3/041 131/198.1 |
| 7,614,402 | B2 | 11/2009 | Gomes | |
| 2014/0238421 | A1 | 8/2014 | Shapiro | |
| 2017/0360092 | A1 * | 12/2017 | Althorpe | A24F 47/008 |

OTHER PUBLICATIONS

Definition of "wick", The Free Dictionary, 2016, [online], retrieved from the Internet, [retrieved Jul. 3, 2019],<URL:https://www.thefreedictionary.com/wick>. (Year: 2016).*
Definition of "wick", The Free Dictionary, Medical Dictionary, no date, [online], retrieved from the Internet, [retrieved Oct. 1, 2019, <URL: https://medical-dictionary.thefreedictionary.com/wick>. (Year: 2019).*

* cited by examiner

*Primary Examiner* — Dennis R Cordray
(74) *Attorney, Agent, or Firm* — Robert M. Schwartz; Alfred K. Dassler

(57) ABSTRACT

A simulated cigarette having an elongated hollow cylinder and having a cavity there within, with a cylindrical wick disposed in the cavity, the wick having a radial clearance and longitudinal clearance with respect to the cavity for allowing the wick to freely slide along a longitudinal direction of the cavity. The simulated cigarette having a fan assembly disposed in the cavity adjacent wick and in an alternate embodiment having a flexible filter affixed to an end of the hollow cylinder.

20 Claims, 5 Drawing Sheets

SIMULATED CIGARETTE

CROSS REFERENCE TO RELATED APPLICATIONS

This application claims the benefit of U.S. Provisional Patent Application 62/462,141, filed Feb. 22, 2017, entitled "Simulated Cigarette" and which the aforementioned application is incorporated herein by reference in its entirety.

BACKGROUND OF THE INVENTION

A simulated cigarette is a therapeutic tool that provides an alternative to tobacco cigarettes. A simulated cigarette can provide a user, typically a person that desires to quit smoking tobacco cigarettes, a healthier solution than smoking cigarettes, that is configured with similar features of an actual cigarette. The simulated cigarette dispenses natural aromas for a user to smell through the nose or inhale air through the simulated cigarette into the user's mouth or lungs.

BRIEF SUMMARY OF THE INVENTION

The present invention is a simulated cigarette that is safer, healthier and a natural alternative to tobacco cigarettes and other nicotine aid products. The simulated cigarette of the present invention can be used by itself or together with other nicotine aid products to help a user satisfy the need of holding a cigarette and therefore overcome the urge for a cigarette and to help make it easier for the user to quit or replace smoking of tobacco cigarettes. The present invention is a therapeutic equipped smoking solution, a stop smoking remedy, a breathable air-based supplement, a quit smoking aid, and a smoking cessation aid. The present invention helps satisfy oral fixations of smoking and hand to mouth gestures associated with smoking, it helps curb cravings for smoking a tobacco cigarette and provides aromatic sensations that are calming and relieving.

The present invention includes an elongated plastic cartridge in the shape of a cylinder that uses breathable air filters infused with aromatherapy ingredients which dispense natural aromatic breathable fragrances which are formulated to be refreshing and relaxing. As opposed to tobacco cigarettes the present invention contains no drugs, no nicotine no tobacco and no batteries.

The cylindrical tube has a mouthpiece at one end and a cover with an opening at the opposite end. The cylindrical tube is hollow and allows the breathable air filter and wick to move back and forth within the cylindrical. This air filter moves back and forth inside the tube when air is being puffed or pulled from the mouthpiece, allowing the filter to adjust the air flow to be either a smooth easy flow or a resistant airflow to make it harder to puff, depending on the user's preferences.

Positioned within the cylindrical tube is a nonelectric air filter wick infused with a blend of all natural aromas made from organic plant extracts (essential oils) which are released each time the user inhales or takes a puff from the simulated cigarette. The aromatic fragrant air filter in the chamber within the cylindrical tube imparts a pleasant aroma to the mouth of the user.

The simulated cigarette can be used to smell or inhale natural essential oils which are very soothing and calming for stress or anxiety. It can also be used to replicate the feeling of holding a cigarette and puffing on the cigarette without the harmful effects of smoking. The present invention offers a fresh aroma or aromatic scent.

It is a primary object of the present invention to provide a natural and safe solution to quit smoking that uses a therapeutic method that helps with quitting smoking as well as helps overcome the psychological and physical aspects of smoking. The present invention uses a breathable air filter infused with aromatherapy ingredients which dispense natural aromas when inhaling the simulated cigarette of the present invention.

The present invention includes a cigarette like cylinder which replicates the look and feel of a cigarette so a user can simulate the feeling of smoking by holding the present invention in their hand or mouth and satisfy habitual behaviors associated with smoking tobacco cigarettes. The present invention is a substitute to using or holding a tobacco cigarette or e-cigarette and provide a psychological and physiological lift when needed or desired. The present invention is a substitute to tobacco cigarettes; e-cigarette's and can be used with other nicotine aid products.

Often times a confirmed smoker finds it difficult to give up smoking even when using nicotine aid products. This is because it is more than just giving up the addictive effect of nicotine, smokers become associated with habitual behaviors such as, hand to mouth gestures, or all fixation, and having something to hold or puff. When a smoker stops smoking, these ritual habits will still exist and they are a major cause of relapse. A confirmed smoker needs a substitute which will give the confirmed smoker a true physiological left which is non-injurious and which may even be beneficial.

The present invention includes a soft filter and has a silicon tip that makes it comfortable to chew on or hold within the user's mouth without hands.

The present invention also includes a unique soft flexible tip, such as a silicon tip and top that makes it comfortable to chew on or hold in the mouth without hands.

With the foregoing and other objects in view there is provided a simulated cigarette having a tube defining a cavity, a wick disposed in the cavity, the wick having radial clearance and longitudinal clearance with respect to the cavity for allowing the wick to freely slide along a longitudinal direction of the cavity.

Additionally, there is provided, in accordance with the invention, a flexible filter affixed to an end of the tube.

In one embodiment the flexible filter has an inside diameter with annular grooves, the tube has a stem with annular collars each received in a respective one of the annular grooves for securing the flexible filter onto the tube.

In another embodiment the flexible filter is a material having a durometer of 40-60 on the Shore A scale.

In yet another embodiment the cylindrical tube has an annular shoulder defining a stop for the wick at a filter end of the cavity.

In another embodiment, the shoulder defines a reduced size aperture in the tube, the wick covers the aperture to restrict airflow when air is drawn through the simulated cigarette.

In yet another embodiment, a rotor is disposed in the cavity adjacent the wick for rotation when air is drawn through the simulated cigarette.

In yet another embodiment, a rotor is an assembly that includes a rotor housing, a cover, and the rotor is rotatably disposed between the cover and the rotor housing.

In yet another embodiment the rotor has an axle, a shroud, and blades spanning between the shroud and the axle.

In another embodiment, the rotor housing has a sleeve that surrounds the rotor and engages the cover to contain the rotor.

In still another embodiment, the tube has a shoulder defining a stop for the wick at a filter end of the cavity.

In yet another embodiment of the simulated cigarette, the shoulder is defined by radially spaced ribs extending in the longitudinal direction.

In another embodiment, the wick abuts the shoulder to reduce a cross sectional surface area of the tube and restrict airflow when air is drawn through the simulated cigarette.

In still another embodiment, of the simulated cigarette, a paper cover covers the outside of the tube.

In still another embodiment of the simulated cigarette the tube is cylindrical.

Other features which are considered as characteristic for the invention are set forth in the appended claims.

Although the invention is illustrated and described herein as embodied in the simulated cigarette, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE PREFERRED EMBODIMENT

A description of the preferred embodiment is set forth herein and in the accompanying figures and drawings.

Figure 1:
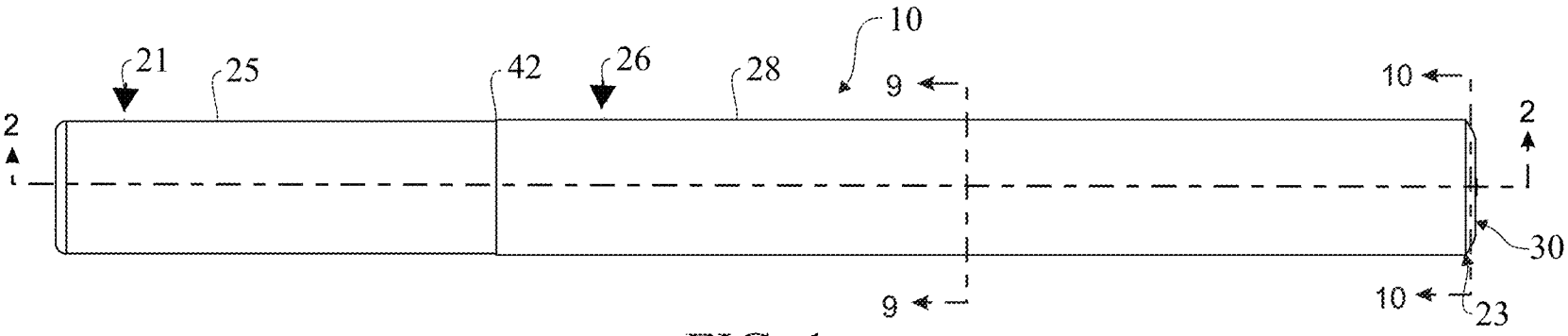
FIG. 1 is a plan view of a simulated cigarette.
Figure 2:
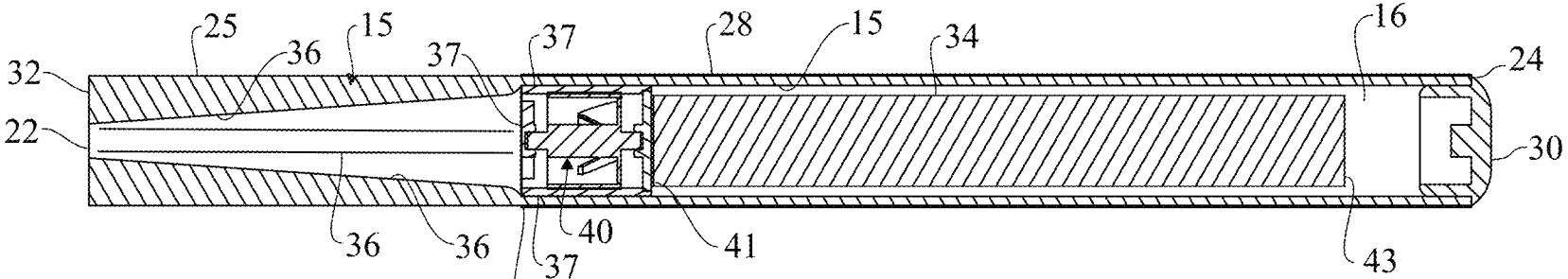
FIG. 2 is a cross sectional view of the simulated cigarette taken along lines 2-2 in FIG. 1.

Referring to FIGS. 1 and 2, is a simulated cigarette 10 of the present invention, which is an elongated hollow cylinder or tube 15 having a first proximal end 21 and a second distal end 23. First end 21 further having an opening 22 and second end 23 having an opening 24. First end 21 also appearing to be the filter 25 of the simulated cigarette 10 and second end 23 being the simulated tobacco end 26 of the simulated cigarette 10.

Figure 9:
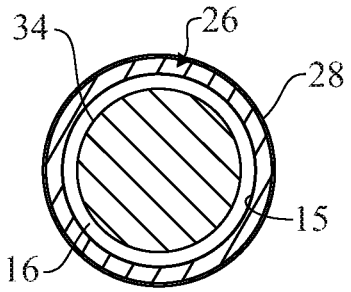
FIG. 9 is a cross sectional view of the simulated cigarette taken along lines 9-9 in FIG. 1.

Hollow cylinder tube 15 is preferably made of plastic though other materials may be used. As best seen in FIG. 9, the tobacco end 26 of hollow cylinder tube 15 is wrapped with a single layer paper cover 28 which gives the simulated cigarette 10 the feel of a real cigarette. Cover 28 can also be a plastic material that looks or feels like a paper cover from a real cigarette. As used herein, a real cigarette is a cigarette having tobacco that is the type of cigarette a user of the simulated cigarette desires to stop using.

Figure 10:
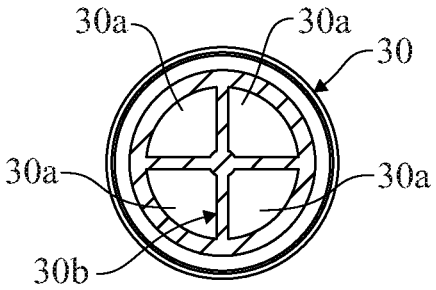
FIG. 10 is a cross sectional view of the insert taken along lines 10-10 in FIG. 1.
Figure 11:
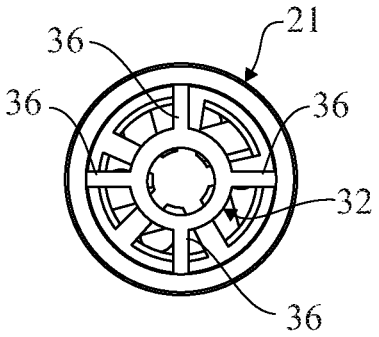
FIG. 11 is an end view of the filter end of the simulated cigarette.

Open second end 23 of hollow cylinder tube 15 has an insert 30 as shown in FIG. 10, to fit within and cover open second end 23. Insert 30 has a center opening 30*a* and a grate 30*b*. Air flows into simulated cigarette 10 and hollow cylinder tube 15 through opening 30*a*. Opening 22 has a grate 32 at opening 22 as shown in FIG. 11.

Within the hollow cylinder tube 15 at the tobacco end 26 is a cylindrical wick 34. Also within the hollow cylinder tube 15 at the filter end 25 are four longitudinal ribs 36 (though one rib cannot be seen in the sectional view of FIG. 2, all ribs 36 can be seen in FIG. 11). The ribs 36, create a shoulder 37 that positions an optional fan assembly 40 within hollow cylinder tube 15 at a longitudinal position corresponding to the junction 42 where the filter end 25 appears to join the tobacco end 26. Wick 34 is dimensioned with clearance to the hollow cylinder tube 15 so that the wick 34 moves within hollow cylinder 15 in such a way that wick 34 freely slides back and forth within the hollow cylinder tube 15 between insert 30 and fan assembly 40 or between insert 30 and shoulder 37, by the user inverting and reinverting the simulated cigarette 10. Wick 34 has a proximal end 41 that will abut fan assembly 40, or shoulder 37 when there is no fan 40, and a distal end 43 that will abut insert 30 when wick 34 moves back and forth along the longitudinal axis of hollow cylinder 15. Hollow cylinder tube 15 defines cavity 16. The wick 34 freely slides back and forth within the cavity 16 in an unimpeded manner. This back and forth motion of wick 34 is soothing to a user of the simulated cigarette 10.

Figure 3:
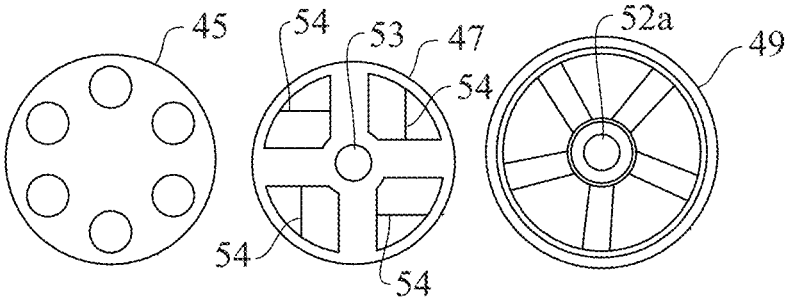
FIG. 3 is an exploded end view of the parts of a fan assembly.
Figure 4:
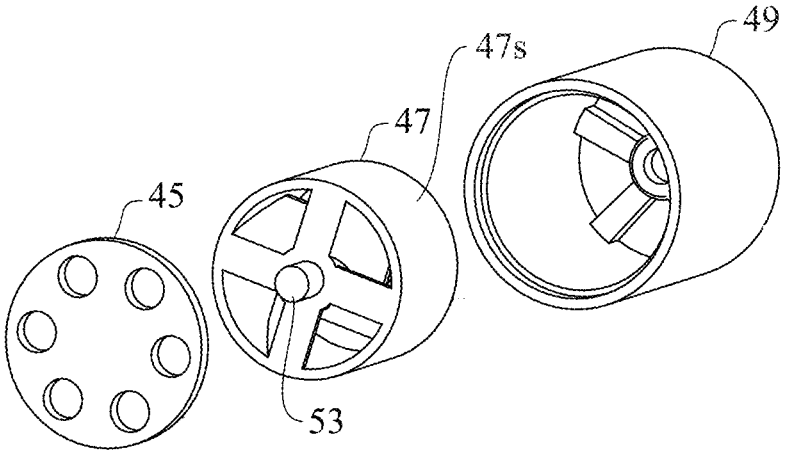
FIG. 4 is an exploded perspective view of the parts of the fan assembly.
Figure 5:
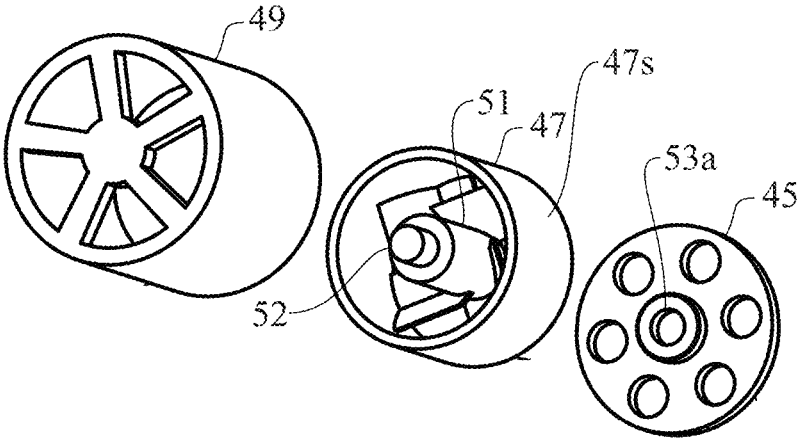
FIG. 5 is an exploded perspective view of the parts of the fan assembly from the opposite direction shown in FIG. 4.

Fan assembly 40 can be seen in FIGS. 3, 4 and 5 in exploded views. The simulated cigarette 10 may or may not have a fan/rotor assembly 40. The fan assembly 40 has a spinner/rotor 47 that rotates when air passes over the blades 54 of the spinner 47 making a sound that also soothes the user of the simulated cigarette 10. Fan assembly 40 has three parts, a cover 45, the rotor 47 and a spinner/rotor housing 49. The rotor 47 fits within housing 49 and has an elongated axle 51. Axle 51 has two ends, one axle end 52 that fits within an opening 52*a* in the housing 49 and a second axle end 53 that fits within an opening 53*a* in cover 45. The fan blades 54 span between the axle 51 and a shroud 47*s*. When a user of simulated cigarette 10 draws air through simulated cigarette 10, air flows through insert 30 into hollow cylinder tube 15, over and past wick 34 and through fan assembly 40 and into filter end 25 and through grate 32. When the air passes through fan assembly 40, the air passes over blades 54 causing spinner 47 to spin within housing 49, the axle ends 52 and 53 rotate within openings 52*a* and 53*a*. As the spinner 47 spins and rotates within housing 49 a sound is emitted which can also be soothing to a user of the simulated cigarette 10.

Figure 6:
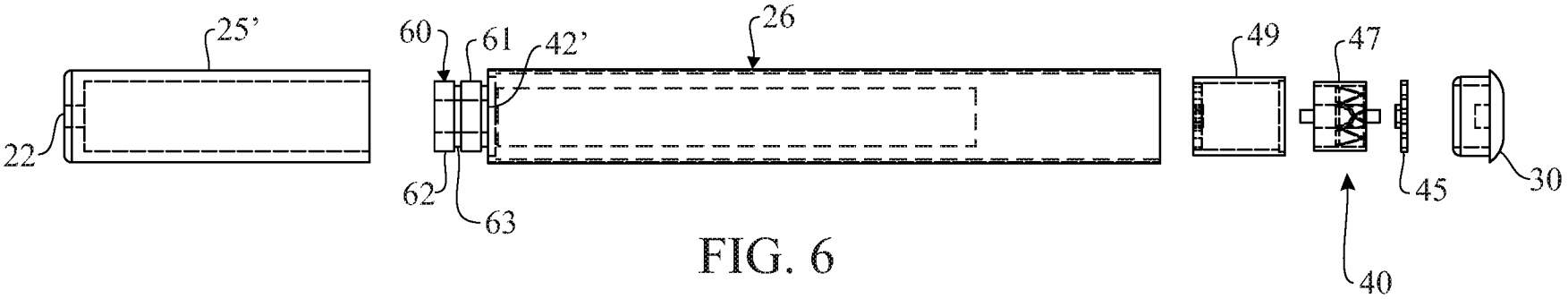
FIG. 6 is an exploded view of an alternate embodiment of the simulated cigarette.
Figure 7:
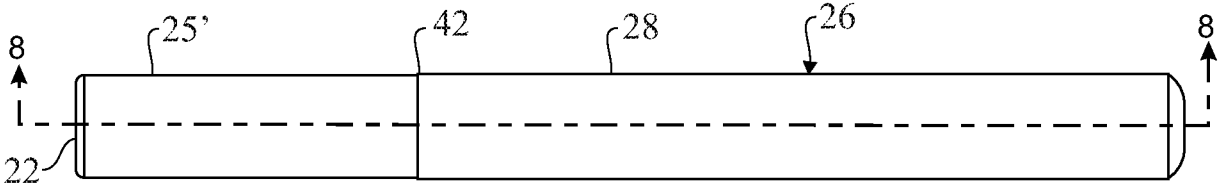
FIG. 7 is a plan view of the alternate embodiment of FIG. 6.
Figure 8:
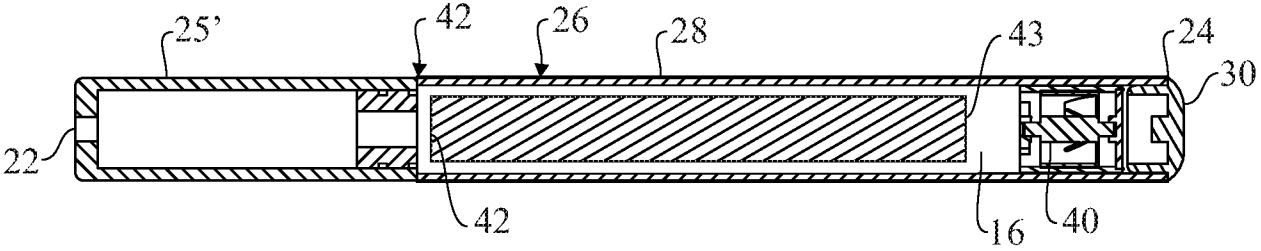
FIG. 8 is a cross sectional view of the alternate embodiment of FIG. 6 taken along lines 8-8 in FIG. 7.

FIGS. 6, 7 and 8 are an alternative embodiment that differs from the embodiment shown in FIGS. 1 and 2 because of a flexible rubber tip filter 25'. Flexible filter 25' is hollow and cylindrical and is constructed of a soft flexible material that can be made of any soft flexible material including TPE and TPR silicone material. The durometer of the soft flexible material being between 40-60 Shore A and most preferably 50 Shore A. This flexible filter soft tip 25' is chewable by a user and is designed for a user to chew on the filter tip 25' and relieve stress and to distract the user from smoking cravings. The filter tip 25' is made of medical grade FDA approved silicone which is safe for a user to put in the mouth and to chew on.

Flexible filter 25' is attached to the tobacco end 26 by fitting over two collars 61 and 62 with a groove 63 between the collars 61 and 62. An annular shoulder 42' is provided on the ID of the hollow cylinder tube 15. It is also possible for the flexible filter 25' to be connected by overmolding the filter 25' onto the cylinder tube 15 in an overmolding process.

In the embodiment shown in FIGS. 6, 7 and 8 the fan assembly 40 is positioned within hollow cylinder tube 15 but at the distal end of the hollow cylinder tube 15 adjacent to insert 30. Fan assembly 40 includes the spinner 47 that spins as previously described. In this embodiment wick 34 still moves back and forth within hollow cylinder tube 15 but between shoulder 42' and the end of the spinner housing 49.

As described herein, in use, a user will draw or puff air from simulated cigarette 10 by drawing air through the simulated cigarette 10 as described. The air will pass over wick 34. The wick 34 is impregnated with aromatic blends of therapeutic aromas. The passing air causes the spinner 47 to spin and create a soothing sound. The simulated cigarette 10 can be moved back and forth or tilted back and forth to allow a user to feel the wick 34 sliding back and forth in the cavity 16 between the filter end and the insert 30. This tapping of the wick 34 against stops (insert 30, fan assembly 40, or shoulder 42') has been found to also create a soothing feeling for the user.

The simulated cigarette can be packaged, like a real tobacco cigarette, one, two or more cigarettes within a sealed pouch to preserve and maintain the aromatic scents within the pouch.

In summary, the simulated cigarette 10 is an elongated cylindrical tube 15 that has a cavity 16 with the cylindrical wick 34 disposed in the cavity 16. The wick 34 has radial clearance and longitudinal clearance with respect to cavity 16 for allowing wick 34 to freely slide along a longitudinal direction of cavity 16. The simulated cigarette 10 has a fan assembly 40 disposed in the cavity 16 adjacent wick 34. In an alternate embodiment simulated cigarette 10 has the flexible filter 25' affixed to an end of hollow cylinder 15.

Figure 12:
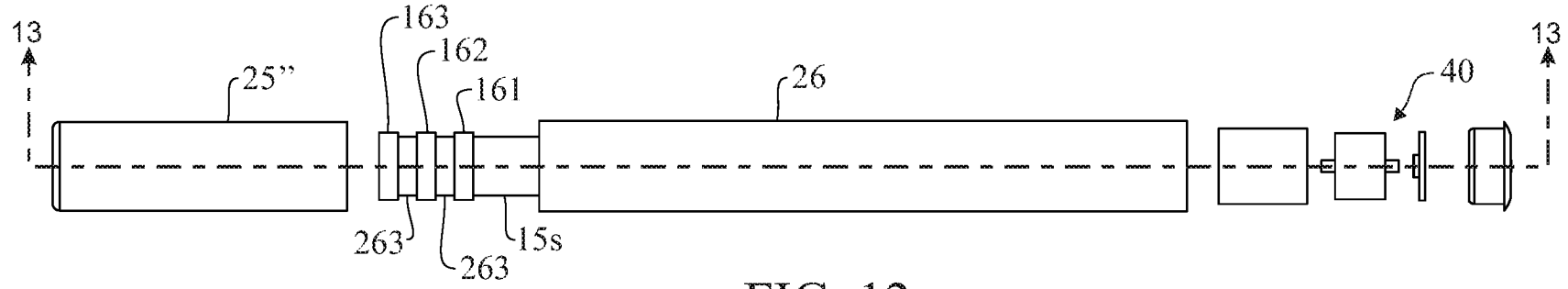
FIG. 12 is an exploded plan view of another embodiment of the simulated cigarette.
Figure 13:
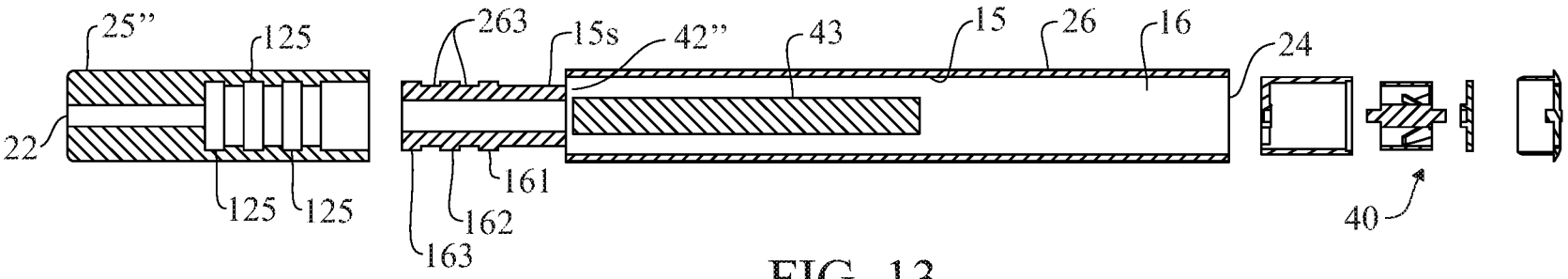
FIG. 13 is a longitudinal cross sectional view of the exploded view of FIG. 12 taken along lines 13-13

FIGS. 12 and 13 show another embodiment with a flexible rubber tip filter 25". Flexible filter 25" is hollow and cylindrical and is constructed of a soft flexible material that can be made of any soft flexible material including TPE and TPR silicone material.

Here, the tube 15 is provided with flexible filter 25" is attached to the tobacco end 26 by fitting over three annular collars 161, 162, and 163 with grooves 263 between the collars 161, 162, and 163. An annular shoulder 42" is provided on the ID of the tube 15 which leads into reduced inside and outside diameters of the tube 15. The reduced outside diameter defines a stem **15*s* on which the collars 161, 162, and 163 are provided. The flexible filter 25" has an ID that corresponds to the OD of the stem 15*s*. The ID has annular grooves 125, that each engage with respective ones of the collars 161, 162, and 163 when the filter 25" is slid onto the stem 15*s*. The engagement of the grooves 125 with the collars 161, 162, and 163 allow the filter 25" to be bent or chewed on by the user without allowing the filter 25" to come off of the stem 15*s*** of the tube.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

We claim:

1. A simulated cigarette comprising:

a tube defining a cavity;

a wick disposed in said cavity, said wick having radial clearance and longitudinal clearance with respect to said cavity for allowing said wick to freely slide along a longitudinal direction of said cavity.

2. The simulated cigarette according to claim 1, further comprising a flexible filter affixed to an end of said tube.

3. The simulated cigarette according to claim 2, wherein said flexible filter has an inside diameter with annular grooves, said tube has a stem with annular collars each received in a respective one of said annular grooves for securing said flexible filter onto said tube.

4. The simulated cigarette according to claim 2, wherein said flexible filter is a material having a durometer of 40-60 Shore A.

5. The simulated cigarette according to claim 1, wherein said tube has an annular shoulder defining a stop for said wick at a filter end of said cavity.

6. The simulated cigarette according to claim 5, wherein said shoulder defines a reduced size aperture in said tube, said wick covers said aperture to restrict airflow when air is drawn through the simulated cigarette.

7. The simulated cigarette according to claim 1, further comprising a rotor disposed in said cavity adjacent said wick and for rotation when air is drawn through the simulated cigarette.

8. The simulated cigarette according to claim 7, wherein said rotor is part of an assembly that includes a rotor housing, a cover, and said rotor rotatably disposed between said cover and said rotor housing.

9. The simulated cigarette according to claim 8, wherein said rotor has an axle, a shroud, and blades spanning between said shroud and said axle.

10. The simulated cigarette according to claim 9, wherein said rotor housing has a sleeve that surrounds said rotor and engages said cover to contain said rotor.

11. The simulated cigarette according to claim 1, wherein said tube has a shoulder defining a stop for said wick at a filter end of said cavity.

12. The simulated cigarette according to claim 11, wherein said shoulder is defined by radially spaced ribs extending in the longitudinal direction.

13. The simulated cigarette according to claim 12, wherein said wick abuts said shoulder to reduce a cross sectional surface area of said tube and restrict airflow when air is drawn through the simulated cigarette.

14. The simulated cigarette according to claim 1, further comprising a paper cover covering said tube.

15. The simulated cigarette according to claim 1, wherein said tube is cylindrical.

16. A simulated cigarette comprising:

a tube defining a cavity;

a filter disposed in said cavity, said filter having radial clearance and longitudinal clearance with respect to said cavity for allowing said filter to freely slide along a longitudinal direction of said cavity; and a flexible filter affixed to an end of said tube.

17. The simulated cigarette according to claim 16, wherein said flexible filter is a material having a durometer of 40-60 Shore A.

18. A simulated cigarette comprising:

a tube defining a cavity;

a filter or wick disposed in said cavity;

a rotor disposed in said cavity adjacent said filter or wick and for rotation when air is drawn through the simulated cigarette.

19. The simulated cigarette according to claim 18, wherein said rotor is part of an assembly that includes a rotor housing, a cover, and said rotor rotatably disposed between said cover and said rotor housing.

20. The simulated cigarette according to claim 19, wherein said rotor has an axle, a shroud, and blades spanning between said shroud and said axle.

* * * * *